United States Patent [19]

Jordan

[11] Patent Number: 4,588,501

[45] Date of Patent: May 13, 1986

[54] APPARATUS FOR COLLECTING AN IMMISCIBLE LIQUID FROM THE SURFACE OF A BODY OF HIGHER DENSITY LIQUID

[75] Inventor: Roland H. Jordan, Redondo Beach, Calif.

[73] Assignee: Chevron Research Company, San Francisco, Calif.

[21] Appl. No.: 526,565

[22] Filed: Aug. 25, 1983

[51] Int. Cl.[4] ..... B01D 35/00

[52] U.S. Cl. ..... 210/109; 210/242.1; 210/242.3; 210/923

[58] Field of Search ..... 210/923, 109, 924, 122, 210/242.3, 776, 767, 799, 800, 805, 242.4; 414/137, 138; 405/63, 64

[56] References Cited

U.S. PATENT DOCUMENTS

| | | | |
|---|---|---|---|
| 1,116,903 | 11/1914 | McClintock | 210/532.1 |
| 3,476,246 | 11/1969 | Dahan | 210/242.1 |
| 3,650,406 | 3/1972 | Brown et al. | 210/242 |
| 3,701,429 | 10/1972 | Schell | 210/242 |
| 3,792,589 | 2/1974 | Sayles | 61/1 F |
| 3,822,789 | 7/1974 | Crisafulli | 210/242 |
| 3,830,370 | 8/1974 | Glaeser et al. | 210/242 |
| 3,853,767 | 12/1974 | Mohn | 210/242.3 |
| 3,883,433 | 5/1975 | March et al. | 210/242 |
| 3,971,719 | 7/1976 | Peters | 210/104 |
| 3,983,034 | 9/1976 | Wilson | 210/83 |
| 4,033,876 | 7/1977 | Cocjin et al. | 210/242.3 |
| 4,049,554 | 9/1977 | Ayers | 210/242.3 |
| 4,096,700 | 6/1978 | Muramatsu et al. | 210/242.3 |
| 4,372,854 | 2/1983 | Szereday | 210/242.3 |
| 4,428,319 | 1/1984 | Henning et al. | 210/242.3 |

*Primary Examiner*—Richard V. Fisher
*Assistant Examiner*—Sharon T. Cohen
*Attorney, Agent, or Firm*—S. R. LaPaglia; E. J. Keeling; P. L. McGarrigle

[57] ABSTRACT

Apparatus for collecting an immiscible liquid from the surface of a body of higher density liquid, including in combination: a floating containment boom and catch basin coupled therewith, the catch basin having a self-adjusting weir for regulating the flow of liquid therein; means for transporting the higher density liquid from the basin to the interior of the floating containment boom for recycling; and means for transporting the lower density liquid from the catch basin to a containment vessel to await further processing.

4 Claims, 3 Drawing Figures

APPARATUS FOR COLLECTING AN IMMISCIBLE LIQUID FROM THE SURFACE OF A BODY OF HIGHER DENSITY LIQUID

INTRODUCTION

The present invention generally relates to apparatus for removing an immiscible liquid, such as oil, from the surface of a body of higher density liquid, such as water. The invention is applicable in connection with all bodies of liquid having floating matter thereon, particularly floating matter in its liquid state, and has particular utility and will be hereinafter described by way of example in connection with the removal of oil floating on water. The reference to oil and water is made simply as an example and is not to be limitative, as the subject invention has commensurate utility in removing any liquid floating atop another.

BACKGROUND OF THE INVENTION

As the supply of oil becomes more scarce, exploration and production activities are increasingly being performed at offshore locations. Attempts to recover offshore oil deposits for commercial use give rise to the possibility that accidental leaks may contaminate our oceans. Further possibilities for oil pollution arise during transportation of crude oil from its deposit location to the refinery or other destination.

To be effective, removal of oil from an oil spill must be rapid. As time elapses, spilled oil becomes more difficult to collect. It spreads rapidly and undergoes changes with time, rendering the oil more dense. The weathering of the oil is related to the condition of the surrounding sea, temperature and oil type. Should spilled oil reach the shore, ecological damage and restoration costs increase astronomically.

Methods for removing hydrocarbon liquids and restoring the quality of the water to desired characteristics include the use of chemical additives to cause a change in the characteristics of the oil; the use of various materials to absorb the oil from the water; and the use of confining devices and pumps to prevent the spread of oil and remove the oil from the surface of the water.

There are three major types of confining devices presently used to recover pollutants floating on a body of water. The first type is a weir-type skimmer, supported on the body of water, that permits the uppermost surface of the body of water to flow into a sump, from which the accumulated liquid is pumped to a separating tank located aboard a floating vessel. The second type is a floating suction skimmer that sucks the upper surface of the water into a separating tank. The third type is an absorbent surface skimmer, combining the characteristics of both absorbent materials and confining devices. The typical absorbent surface skimmer includes a rotating absorbent belt removing oil from the water surface and depositing it in a collection pan.

Present weir-type skimmers share at least one of the following inadequacies: inability to operate effectively in other than substantially calm waters, inability to recover oil at rates desirable for a major spill, and inability to be deployed quickly because of size and weight. The first inadequacy is the most common of existing weir-type skimmers. As wave heights increase, the oil-to-water recovery rate decreases. The increased water intake is due to the inability of the skimmer to conform to the sea surface.

The second inadequacy, low oil recovery rates, is due, in part, to the problem of wave heights, previously discussed, and also to design restrictions and deficiencies. A skimmer must be able to provide high volume flow rates for oil slicks of different depths. The recovery device should be able to operate effectively in both very thin and very thick oil slicks and be capable of adjusting output relative to the amount of oil recovered.

The last inadequacy concerns deployment of the skimmer. Storage, transport and operation of the skimmer become increasingly difficult with size and weight gains.

The present invention provides a method and means for collecting an immiscible liquid from the surface of a body of higher density liquid which is not subject to the deficiencies of the prior art.

SUMMARY OF THE INVENTION

The present invention combines elements of a weir-type skimmer and a floating suction skimmer, and adds new components, providing an apparatus superior to the prior art. Field tests of a prototype skimmer have indicated an oil recovery rate of 95% oil and 5% water ratio.

The system of the present invention provides efficient collection of oil and includes in combination: a floating containment boom, including an outlet opening; a catch basin, including flotation to maintain its uppermost edge above the oil, a sump and an inlet opening, the boom outlet opening coupled therewith; a self-adjusting weir disposed within the catch basin inlet opening to regulate the flow of liquid into the basin; a water pump coupled with the catch basin sump to remove and discharge water therefrom; and an oil pump coupled with a skimming head for removing and discharging oil therefrom.

The floating containment boom guides the oil slick to the basin inlet opening where it is directed over the floating weir. The weir aids in separating the oil from the subjacent water. Oil and a limited amount of water directed over the weir, pass into the catch basin. The water within the basin is pumped from the sump and transported to the interior of the floating containment boom for recycling in accordance with the foregoing-described procedure. The oil within the basin is pumped from the skimming head located therein, to a containment facility for processing.

PRINCIPLE OBJECT OF THE INVENTION

An object of the present invention is to provide a skimmer by which floating pollutants, such as oil, along with a thin layer of higher density liquid, such as water, may be collected in a catch basin and be substantially separated; the water transported to the interior of the floating containment boom; and the oil contained within the catch basin.

Another object of the invention is to provide a skimmer in accordance with the preceding object while simultaneously removing and transporting the oil collected in the catch basin to a storage facility for processing.

Further objects of the invention are to provide a skimmer capable of operating in turbulent waters, capable of recovering oil rapidly, and capable of being readily transported and assembled.

Additional objects and advantages of the present invention will become apparent from a detailed reading of the specification and drawings which are incorporated herein and made a part of this invention.

DESCRIPTION OF THE PREFERRED EMBODIMENT

Figure 1:
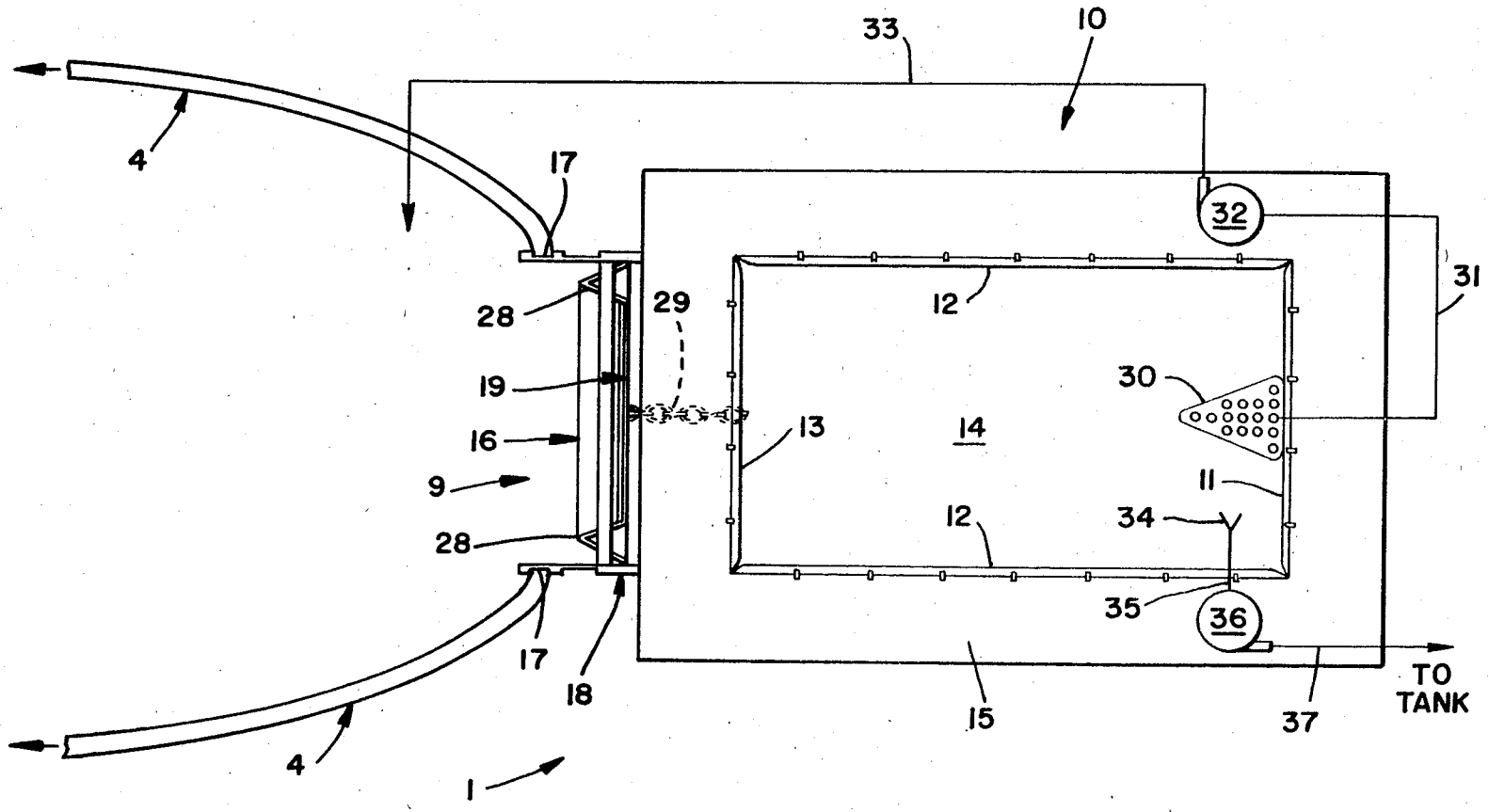
FIG. 1 is a schematic plan view of a skimmer, according to an embodiment of the present invention, floating on a body of water from which a surface layer of oil is to be skimmed.
Figures 2, 3:
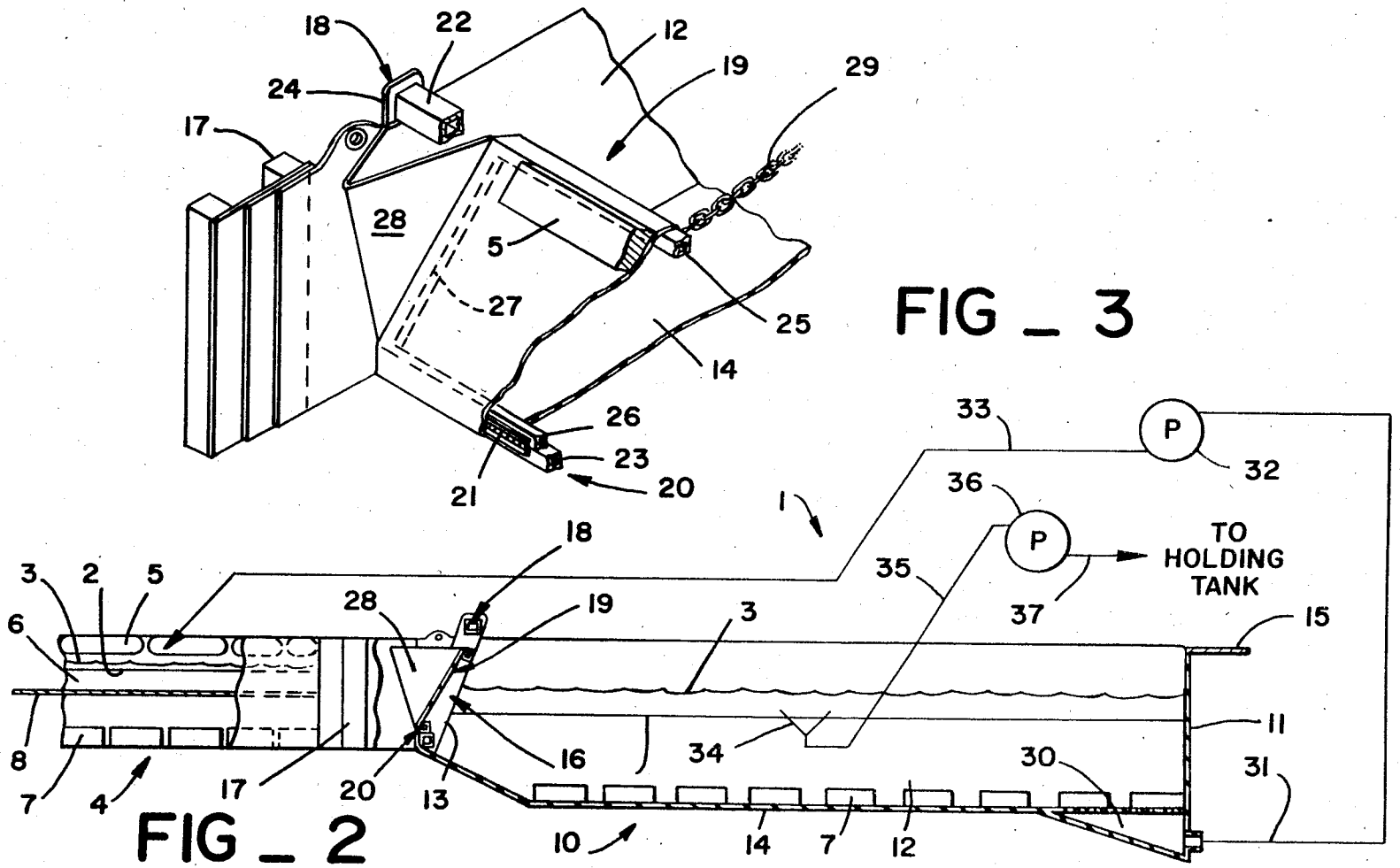
FIG. 2 is a schematic representation in side elevation of the skimmer of FIG. 1.
FIG. 3 is a developed view of the weir section of FIGS. 1 and 2.

Referring now in detail to the drawings, and in particular to FIGS. 1 and 2, a skimmer 1 is located in a body of water 2. An immiscible liquid 3, such as oil, floats atop the higher density liquid 2.

A floating oil containment boom 4 is constructed from material causing it to be impermeable to water, oil and air. Flotation chambers 5 extend along the uppermost edge of the boom 4 or are incorporated therein to maintain the uppermost boom edge above the oil, forming a barrier for the contaminants. The flotation chambers 5 are preferably individualized compartments to selectively buoy the boom and provide flexibility. The sides or skirt 6 of the boom extend below the flotation chambers 5 and incorporate elements hereinafter described. Ballast 7 extends along the lowermost edge of the skirt 6 or is incorporated therein, to maintain the skirt 6 in its submerged state. Ballast 7 may include a chain or chambers containing lead sheeting. Individual chambers provide selective ballasting and skirt flexibility in the area of the ballast.

Although the fabric from which the boom 4 is constructed is suitable for ordinary handling, it is not designed to withstand the high tensile stresses imposed upon the boom from waves, wind and current. Tensile cable 8, placed in the skirt 6 and extending along its longitudinal median, provides means for accepting and distributing the stresses to prevent damage to the fabric of the boom.

Boom outlet opening 9 directs liquid into catch basin 10. Catch basin 10 is constructed of material similar to that of the containment boom 4. A rear wall 11, side walls 12, front wall 13 and bottom wall 14 cooperate to define a generally rectangular-shaped receptacle or basin. Boom connectors 17, located on the basin side walls 12 and boom skirt 6, provide means for joining the boom 4 and basin 10.

Although flotation may extend along the uppermost edge of the basin or be incorporated therein to maintain the uppermost basin edge above the oil, the preferred embodiment illustrates a floating deck 15 encompassing the basin perimeter to which the basin is lashed. Ballast 7 extends along the lowermost edge of the front wall 13, rear wall 11 and side walls 12, or is incorporated therein to maintain the basin configuration. Like the boom ballast, the basin ballast may include a chain or lead sheeting. Individualized chambers provide selective ballasting and flexibility. Alternatively, rigid framing may extend below the floating deck to which the walls are lashed, thereby maintaining the basin configuration.

The front wall 13 of the basin 10 is provided with an inlet opening 16 which extends horizontally and vertically in the front wall 13 so that the lowermost edge thereof is below the water level to assure gravity inflow of water and oil into the catch basin 10. The relationship of the water level to the inlet opening 16 is representatively illustrated in FIG. 2, but this relationship may vary depending upon the flotation characteristics of the basin, and is not critical except that the lower edge of the basin inlet opening 16 must be below the water level of the body of water 2. Inlet framing 18, including upper 22, lower 23 and side 24 inlet framing members, defines the perimeter of the basin inlet opening 16 and maintains the rigid inlet opening shape.

Disposed within the inlet opening 16 is a self-adjusting weir 19. FIG. 3 illustrates a developed view of the weir of FIGS. 1 and 2. Weir 19 is constructed from material similar to that of the boom 4 and basin 10. Weir 19 substantially simulates the configuration and size of inlet opening 16. Weir framing 20, including upper 25, lower 26 and side 27 weir framing members, maintains the rectangular configuration of the weir. Hinged connection 21 joins lower weir framing member 26 with lower inlet framing member 23. Flotation 5 extends along the uppermost edge of the weir 19 or may be incorporated therein to maintain the uppermost edge of the weir at a desired elevational position in relation to the surface of the body of water 2, independent of changes in elevational position of the catch basin. Wing hinges 28, located between the side weir framing members 27 and side inlet framing members 24, prevent fluid from passing therebetween. Chain 29, connected with upper weir framing member 25, provides means for manually adjusting the weir elevation relative to the body of water 2.

Sump 30, located within the bottom wall 14, substantially receives water accumulated within the catch basin 10. Water pump inlet hose 31 is coupled with sump 30. Water pump 32, located on deck 15, transports water from water pump inlet hose 31 through water pump discharge hose 33 to the interior of the floating containment boom 4.

Skimming head 34, located within catch basin 10 and immediately above the oil-water interface, receives oil accumulated within the basin. Oil pump inlet hose 35 is coupled with skimming head 34. Oil pump 36 transports oil from oil pump inlet hose 35 through oil pump outlet hose 37 to a containment vessel (not shown) for further processing.

Although the preferred embodiment incorporates the above-described means for transporting oil, catch basin 10 may be concurrently utilized as a containment vessel in which oil may be stored to await further processing, thereby avoiding any necessity for oil transporting means.

In operation, two towboats will be connected, in the vicinity of the oil spill, to the opposite ends of the floating containment boom 4 for movement in the direction of the oil spill as indicated by arrows in FIG. 1. The boom 4 will assume a parabolic contour in response to tow movement. Oil and water are trapped by the boom 4 and are funneled toward the catch basin 10. Oil and water funnel through boom outlet opening 9 toward self-adjusting weir 19 disposed within catch basin inlet opening 16.

Weir 19 is self-adjustable, but may be manually adjusted utilizing chain 29, if so desired. Weir 19 regulates the flow of liquid into catch basin 10. A surface layer of oil and a limited amount of water passes over weir 19 into catch basin 10. The inherent attributes of catch basin 10 dampen wave action therein, promoting separation of oil and higher density water.

Oil and water are simultaneously removed from catch basin 10. If the rate of admission of liquid to catch basin 10 is greater than the discharge of pumps 32 and 36, then the buoyancy of the weir will cause it to rise so as to reduce or discontinue the flow of liquid over the weir.

Water pump 32, located on deck 15, pumps water from sump 30, located within catch basin bottom wall 10, through water pump inlet hose 31 and water pump discharge hose 33, discharging the water into the interior of the boom 4, thus enabling the water to be recycled through the foregoing-described procedure. Oil pump 36 pumps oil from skimming head 34, located within catch basin 10 and immediately above the oil-water interface, through oil pump inlet hose 35 and oil pump outlet hose 37 to the containment vessel for further processing.

Since many modifications and variations of the present invention are possible within the spirit of this disclosure, it is intended that the embodiment disclosed is only illustrative and not restrictive, reference being made to the following claims rather than to the specific description to indicate the scope of this invention.

What is claimed is:

1. An apparatus for removing oil from the surface of a body of water, the operation of which is substantially independent of fluctuations in the surface level of the body of water and which moves, relative to the oil, in one forward direction, comprising:

a catch basin having a closed bottom and an open top, and made of flexible material which is impervious to air, oil, and water;

a flexible flotation means for flexibly supporting the catch basin above the surface level of the water to allow said catch basin to ride the surface of the water in a serpentine fashion without regard to fluctuations in the surface level height;

a liquid inlet formed in said catch basin;

a self-adjustable weir horizontally disposed across said liquid inlet of said catch basin and means for adjusting said weir at a constant height under the surface of the water so that only the top layer of the body of water, which contains the oil, will be collected;

means for vertically hinging both sides of said weir to said catch basin so that all liquids are forced over the top of said weir and prevented from going past the ends of the weir;

a liquid outlet located in the bottom of said catch basin to permit removal of water from beneath the overlying oil in said catch basin and to establish flow over the top of said weir thereby increasing concentration of oil in said catch basin;

a first pump to remove water from said catch basin through said liquid outlet and to pump water back into said body of water to assist in directing the oil over the weir;

a second pump having an intake in the oil phase above the oil/water interface to remove the oil from the basin; and means for moving said apparatus forward, in one direction, relative to the oil on the surface of a body of water.

2. The apparatus as described in claim 1 further comprising a floatation boom to assist in directing surface oil toward said liquid inlet.

3. The apparatus as described in claim 1 further comprising a working platform attached to said flexible floatation means.

4. The apparatus as described in claim 1 further comprising a floating deck means for mounting both said first pump and said second pump.

* * * * *